United States Patent [19]

Jackson et al.

[11] 4,210,075

[45] Jul. 1, 1980

[54] BOTTOM FOR LINT FEEDER HOUSING

[75] Inventors: Richard E. Jackson; Robert C. Schwartz; John E. Sparks, all of Lubbock, Tex.

[73] Assignee: Horn and Gladden Lint Cleaner Company, Inc., Lubbock, Tex.

[21] Appl. No.: 962,137

[22] Filed: Nov. 20, 1978

[51] Int. Cl.[2] ..... B30B 15/30

[52] U.S. Cl. ..... 100/35; 19/58; 29/402.08; 100/215

[58] Field of Search ..... 29/401; 100/215, 35; 19/58, 64.5

[56] References Cited

U.S. PATENT DOCUMENTS

| | | | |
|---|---|---|---|
| 2,837,022 | 6/1958 | Day | 100/215 |
| 3,186,448 | 6/1965 | Clark | 100/215 X |
| 3,386,370 | 6/1968 | Knipp | 100/215 X |

OTHER PUBLICATIONS

"Handbook for Cotton Ginners", U.S. Dept. Agriculture Handbook No. 260, pp. 55–57, Feb. 1964.

*Primary Examiner*—Billy J. Wilhite
*Attorney, Agent, or Firm*—Wendell Coffee

[57] ABSTRACT

The bottom of a lint feeder housing is manufactured such that the high speed belt which it houses is quickly and easily changed. The bottom of the housing is lowered after loosening the four hinged thumb bolts which secure the bottom to the housing. After the bottom is lowered, the axles which support conveyor rollers are lowered a little on one side. The worn belt is removed and a new belt is slipped between the axles and the frame of the housing then over the rollers. Once the new belt is in place, the axles are raised and the bearing housings are fixed to the feed housing. Finally, the bottom of the housing is raised and secured in place.

3 Claims, 3 Drawing Figures

BOTTOM FOR LINT FEEDER HOUSING

BACKGROUND OF THE INVENTION (1) Field of the Invention

This invention related to the feeding of fibrous material into a press for baling. More specifically, it pertains to facilitating the rapid change of the belt which conveys the material to the press.

(2) Description of the Prior Art

Machines for ginning cotton have been known in the art since Eli Whitney's invention was patented in 1794. Modifications and improvements on the original machine have been made until the machines generally used today are quite efficient. As recently as 1968, the basic machine has been improved by the implementation of new bale typing and packaging techniques. To a great degree, the improvements now being made on the cotton gin go to the prevention of lost "down time" and not to general changes in the gin machinery.

As the capacity of gins has increased, greater strain has been placed on the components and as a result they wear out faster and must be replaced more often. Many components of the gin machinery may only be changed while the whole gin is stopped. This is the case with the lint feeder belt.

Lint cotton is prepared for baling by first condensing the ginned lint into a batt by air-feeding the cotton onto a slowly turning wire mesh drum. The batt is forwarded through a lint chute onto a lint feeder. The lint feeder is made up of a conveyor belt, either with or without cleats, a housing for the belt and rollers. At least one of the rollers rotatably driven by chain or belt drive. This rotation imparts motion to the belt. The lint feeder feeds the batt into the press. In preparation for baling, the batt is tramped down about ten times per bale. The belt must stop each time the tramper descends and start again after it is raised. This stopping and starting causes wear and tear on the belt. Most high speed gins average processing about 12 bales per hour, though the capacity may be considerably higher. Also, during the ginning season the machinery may run 20 to 24 hours per day. Therefore, the belt may stop and start around 3000 times per day.

Heretofore, the belts commonly used to convey the batt into the press could not be of the "endless" type but were laced belts. The laced belts are used because installing a never ending belt was an arduous task, if not impossible althogether, without completely breaking the machine down. A laced belt is installed by training the belt over the rollers, aligning the belt over the rollers, aligning the teeth of the lace with one another then inserting a pin through the teeth. The laced belts wear out at the teeth of the laces due to friction with the rollers. Never ending belts do not have such a weak point and so last longer with less wear and tear on the rollers.

The lint feeder housings of gins in use today are made cleanable by doors on the side of the housing which open between the runs of the belt. Changing of the belt in most models is accomplished by removing the bottom of the housing. After the bottom is withdrawn, the rollers and belt are visible but not very accessable. In order to more easily change the belt, the rollers may be dropped down. The rollers are dropped down by removing the axles from bearing housings at either end of the axles. This is accomplished by loosening a set screws then driving the axles out of the set collar. This is clearly quite a task. In order to replace the axles and rollers into position, the axles must be blindly reinserted through the rollers and into the bearing housings. The blind insertion is very difficult and time consuming at best. Obviously, the time consumed by this process is great especially when it is considered that the whole gin is idled during the process.

To the best of applicants' knowledge, there is no lint feeder housing which is designed to facilitate a more rapid and efficient method of change the lint feeder belt.

In recent years, synthetic fibrous materials have been used and the equipment for baling these fibers is substantially identical to cotton lint equipment.

SUMMARY OF THE INVENTION (1) New and Different Function

We have invented a way to facilitate the quick and easy change of a lint feeder belt. Our invention greatly decreases "down time" lost in ginning operations due to a common cause.

With our invention, the lint feeder belt is changed by merely (1) loosening four thumb bolts; (2) lowering the bottom of the lint feeder housing; (3) loosening the two bolts of the bearing housing on the bottom of the frame on either side of the axles; and (4) removing two bolts from the frame and from each bearing housing such that they are dropped a little bit. These steps are quickly performed because each bolt is easily accessable and there is no need to take the axles out of the bearing housings. The axles and rollers are put back into position by merely replacing or retightening bolts which were removed or loosened previously. Therefore, there is no need to blindly insert the axles through the rollers and into bearing housings. It is clear that by dropping the axles, bearings, bearing housings, and rollers as a unit, the time necessary to change a belt is greatly reduced and the belt used is better so great results are obtained.

It is also possible to clear the area between the belt's runs as desired by merely dropping the bottom of the housing. This cleaning would decrease the wear and tear on the belt as debri would not be forced between the belt and the rollers. Further access doors are not needed because of the ease of dropping the bottom.

The invention has equal utility in baling other fibers.

Thus, it may be seen that the function of the entire combination far exceeds the sum of the functions of the individual bolts, bearings, axles, belts, etc.

(2) Objects of this Invention

An object of this invention is to feed fibrous material to a press.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 4 is a side elevation view showing a detail of the connection between the bottom and frame with the bottom in the closed position.

DESCRIPTION OF THE PREFERRED EMBODIMENTS

The invention is described in the text of a cotton gin, however, it is equally applicable to other fibrous material, e.g., synthetics.

Figure 1:
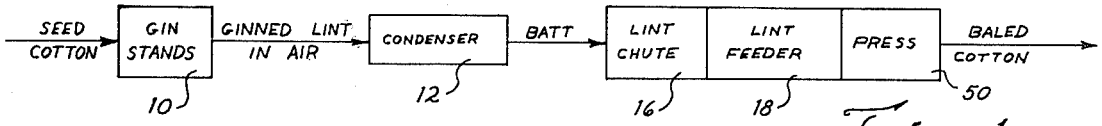
FIG. 1 is a block diagram of a portion of a cotton gin.
Figure 2:
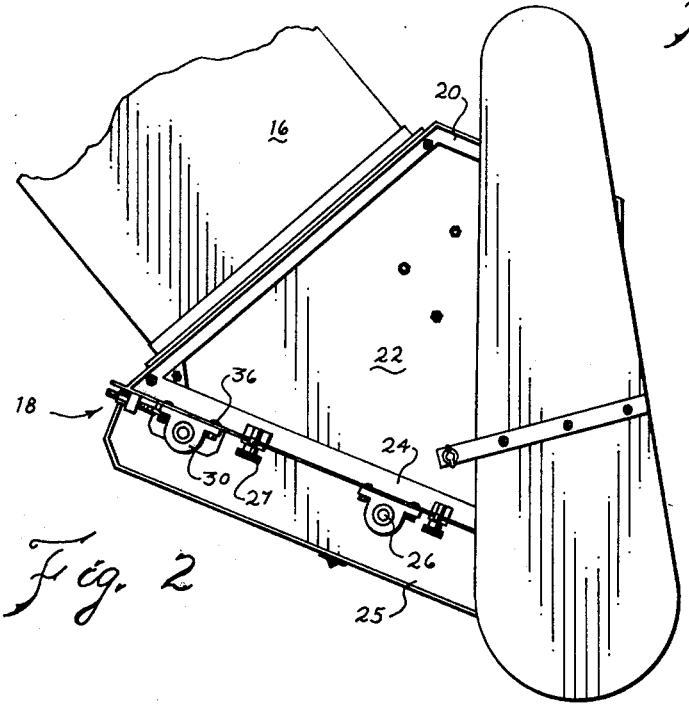
FIG. 2 is a side elevational view of a lint feeder according to our invention with the bottom up.
Figure 3:
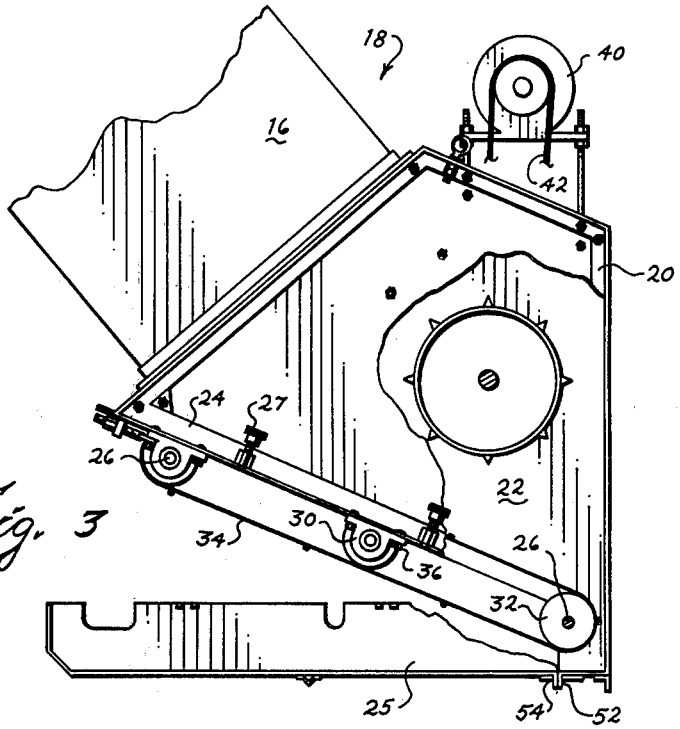
FIG. 3 is a side elevational view partially broken away to show details of construction of the feeder of FIG. 1, with the bottom down.

Referring to the drawings, FIG. 1 represents parts of a cotton gin for the processing and baling of lint cotton. After the seed and trash have been removed from the cotton in the stands 10, the lint is condensed in condenser 12 which contains a wire screen drum which rotates. As the condenser 12 rotates, the cotton lint forms a batt. The batt is transmitted through lint or batt chute 16 to lint feeder 18.

The lint feeder 18 includes housing frame 20 and housing 22, the lower portion of which is called herein the main structural member 24. The main structural member also has bottom 25 held against frame 20 by thumb bolts 27 hinged to the member 24. Axles 26 are journalled in bearings held in bearing housings 30. The axles 26 extend through and support rollers 32 and facilitate their rotation. Belt 34 is trained around the rollers 32. The belt 34 may be cleated or smooth. The belt rapidly conveys the batt into tramper or press 50 where it is prepared for baling. The tramper press or has a foot which descends about 10 times per bale of cotton. Each time the foot descends the belt must stop, the belt must restart once the foot ascends.

Cross beam 52 adjacent the press runs across the width of the main structural members 24 with holes through the beam 52. Pins 54 on the bottom 25 are inserted through the holes effectively making a hinge about which the bottom 25 pivots when it is raised and lowered.

In FIG. 1, it may be seen that rotation source 40 in the form of an electric motor sits atop the housing 22. The rotation source 40 drives a belt which ultimately transmits the rotation to the axles 26. For safety, belt 42 is covered by a belt shield. The shield is held in place by a bar through which screws run attaching the bar to the housing. In order to gain easy access to the axles 26 closest to the press 50, the belt shield must first be removed by removing the screws. Both bearing housings 30 to which the axle 26 closest to the press is journalled must be completely loosened by taking bolts 36 out of the housings 30 on both ends of the axles 26. The roller is there free to move forward. In this manner tension on belt 34 is released. When a new belt is installed, the bearing housings 30 are returned to their original positions and tension on the belt is restored.

The bearing housings 30 are bolted to the bottom of main structural member 24 by bolts 36. The main structural member 24 angles forward and downward from the lint chute 16 to the tramper 50. There are two bolts 36 per bearing housing 30 and one at the bearing housing 30 is located at each end of each axle 26. The axles are journalled to the bearings therein. It may be seen that by loosening bolts 36 through bearing housings 30 on one end of the axle and removing those bolts 36 from bearing housings 30 on the opposite end of the axle 26 the axle, and the roller 32 thus supported will be angled down on the side where the bolts were withdrawn. A space is formed between the bearing housing 30 and the housing 22 through which an old belt may be withdrawn and a new one installed. The lint feeder 18 is made ready for use again by repeating the foregoing steps in reverse order. I.e., after the new belt is installed, the nearmost bearing housings are fixed to the bottom of the housing frame, tightening the belt. The other bearing housings are tightened to the bottom of the frame, the bottom is raised and thumb bolts are replaced and tightened and the shield is replaced.

The embodiment shown and described above is only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In a cotton gin having
   a. a condenser to condense the fiber into a batt,
   b. a batt chute to move the batt from the condenser to
   c. a feeder having:
      (i) a pair of main structural members extending forward and down,
      (ii) at least two axles journalled to
      (iii) bearings,
      (iv) said axles extending through rollers,
      (v) a belt trained around said rollers, and
   d. a press to receive batt from the feeder; wherein the improvement comprises:
   e. said bearings bolted to the bottom of the main structural members, and
   f. a bottom bolted to the main structural member.

2. The invention as defined in claim 1 further comprising:
   g. a cross beam between the main structural members adjacent to said press and
   h. pins on the bottom inserted in holes in the cross beam,
   j. thumb bolts on to the main structural members fixing the bottom to the main structural member.

3. In a plant for processing fibrous material having
   a. a condenser to condense fiber into a batt,
   b. a batt chute to move the batt from the condenser to
   c. a feeder having:
      (i) a pair of main structural members extending forward and down,
      (iii) at least two axles journalled to
      (iii) bearings,
      (iv) said axles extending through rollers,
      (v) a belt trained around said rollers, and
   d. a press receiving batt from the feeder, the method of replacing said belt when worn comprising the steps of:
   e. lowering a bottom from said main structural members,
   f. dropping the rollers, axles and bearings as a unit from the main structure member, then
   g. removing the worn belt,
   h. installing a new belt,
   j. raising the rollers, axles and bearings back up to the bottom of the frame of the main structural members, then
   k. raising the bottom to the main structural members.

* * * * *